US005921122A

United States Patent [19]

Lin

[11] Patent Number: 5,921,122

[45] Date of Patent: Jul. 13, 1999

[54] DEVICE FOR PREVENTING FALLING OF UPPER PIN TUMBLERS OF A LOCK DURING CHANGE OF A LOCK CORE IN THE LOCK

[75] Inventor: Jesse Lin, Kaohsiung Hsien, Taiwan

[73] Assignee: Taiwan Fu Hsing Industry Co. Ltd., Kaohsiung Hsien, Taiwan

[21] Appl. No.: 09/084,382

[22] Filed: May 27, 1998

[51] Int. Cl.[6] ..... E05B 27/00

[52] U.S. Cl. ..... 70/368; 70/384; 70/394

[58] Field of Search ..... 70/368, 382, 384, 70/394

[56] References Cited

U.S. PATENT DOCUMENTS

| | | | |
|---|---|---|---|
| 3,149,486 | 9/1964 | Russell et al. | 70/384 |
| 3,320,781 | 5/1967 | Hill | 70/384 |
| 3,589,153 | 6/1971 | Hill | 70/384 |
| 4,484,462 | 11/1984 | Berkowitz | 70/368 |
| 4,667,494 | 5/1987 | Joosten | 70/394 |
| 4,836,002 | 6/1989 | Monahan | 70/368 X |
| 5,103,661 | 4/1992 | Fann et al. | 70/384 X |
| 5,172,578 | 12/1992 | Bitzios | 70/394 |
| 5,211,044 | 5/1993 | Kim | 70/384 X |
| 5,325,691 | 7/1994 | Embry | 70/394 |
| 5,718,136 | 2/1998 | Aldieri et al. | 70/384 X |
| 5,752,400 | 5/1998 | Kim | 70/368 |

*Primary Examiner*—Suzanne Dino Barrett

*Attorney, Agent, or Firm*—Watson Cole Grindle Watson, P.L.L.C.

[57] ABSTRACT

A lock assembly includes a main body having a compartment defined in a lower part thereof for removably receiving a lock core therein. The main body further includes a number of upper chambers defined in an upper part thereof, each upper chamber including an upper pin tumbler received therein. The lock core includes a number of lower chambers defined therein, each lower chamber including a lower pin tumbler received therein. The main body further includes a number of longitudinally spaced holes defined in a periphery thereof each hole being communicated with a lower end of an associated upper chamber. A member has a number of branches, wherein each branch is removably inserted into an associated hole to support the associated upper pin tumbler during removal of the lock core.

2 Claims, 3 Drawing Sheets

DEVICE FOR PREVENTING FALLING OF UPPER PIN TUMBLERS OF A LOCK DURING CHANGE OF A LOCK CORE IN THE LOCK

BACKGROUND OF THE INVENTION

1. Field of the Invention

The present invention relates to a device which may prevent the upper pin tumblers of a lock from falling during change of a lock core in the lock.

2. Description of the Related Art

Taiwan Patent Laid-Open No. 163799 discloses a door lock with a changeable lock core in which the upper and lower pin tumblers can be changed in the case that the lower pin tumblers are worn due to a long-term usage or the key is lost. It is found proper to change the lower pin tumblers only, yet the upper pin tumblers may fall due to gravity during change of the lower pin tumblers. As a result, troublesome re-assembly of the upper pin tumblers and springs are required. The present invention is intended to provide a device to solve this problem.

SUMMARY OF THE INVENTION

It is a primary object of the present invention to provide a device which may prevent falling of the upper pin tumblers during change of the lock core.

A lock assembly in accordance with the present invention comprises a main body including a compartment defined in a lower part thereof for removably receiving a lock core therein. The main body further includes a number of upper chambers defined in an upper part thereof, each upper chamber including an upper pin tumbler received therein. The lock core includes a number of lower chambers defined therein, each lower chamber including a lower pin tumbler received therein. The main body further includes a number of longitudinally spaced holes defined in a periphery thereof, each hole being communicated with a lower end of an associated upper chamber. A member has a number of branches, wherein each branch is removably inserted into an associated hole to support the associated upper pin tumbler during removal of the lock core. Preferably, each branch includes a beveled end to assist in the insertion thereof.

Other objects, advantages, and novel features of the invention will become more apparent from the following detailed description when taken in conjunction with the accompanying drawings.

DETAILED DESCRIPTION OF THE PREFERRED EMBODIMENT

Figure 1:
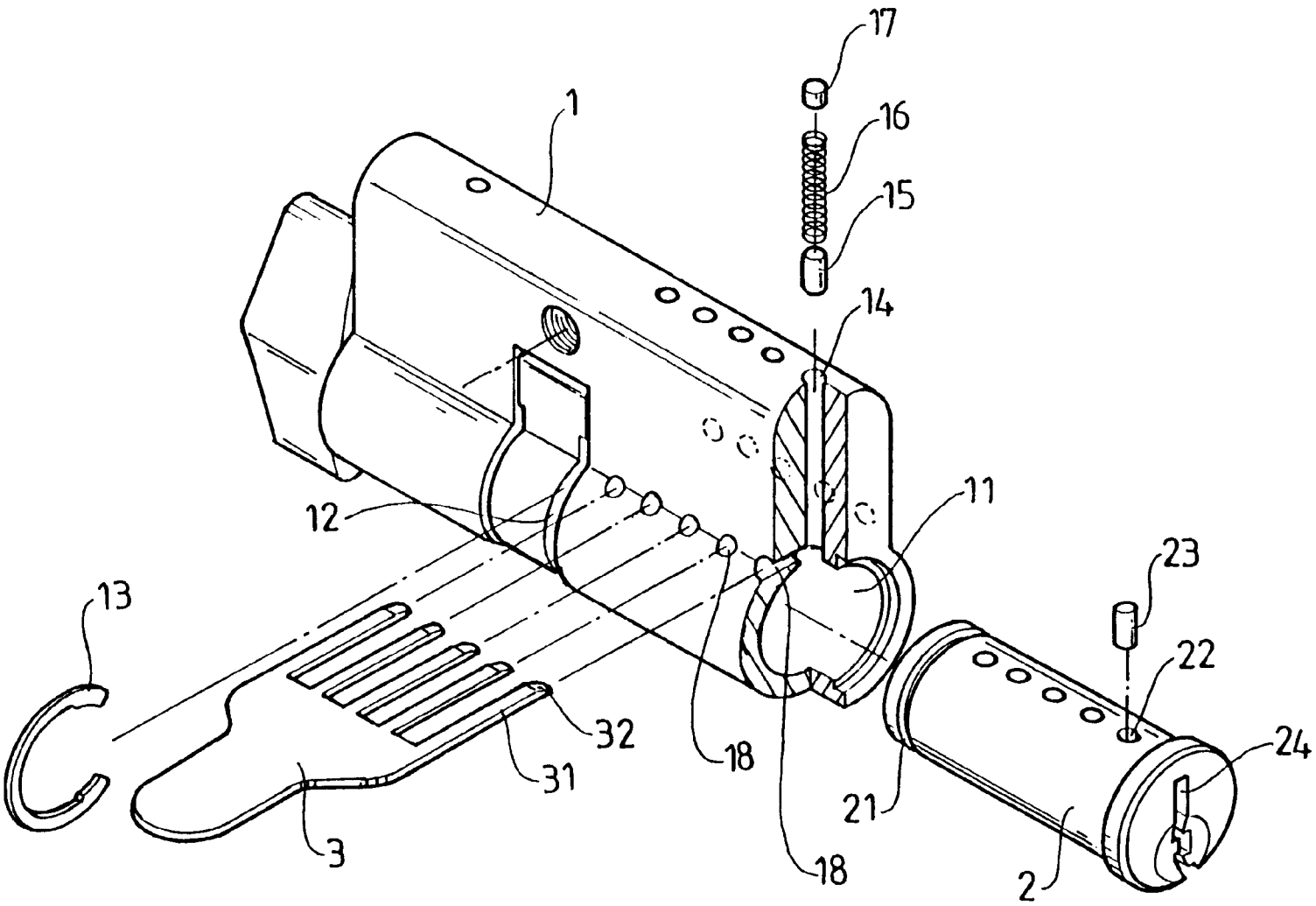
FIG. 1 is a perspective view, partly cutaway, of a lock assembly in accordance with the present invention.

Referring to the drawings and initially to FIG. 1, a lock assembly in accordance with the present invention generally includes a main body 1 having a compartment 11 defined in a lower part thereof for removably receiving a lock core 2. The main body 1 further includes a number of upper chambers 14 each of which is communicated with the compartment 11 and receives a spring 16 and an upper pin tumbler 15 therein. An enclosing element 17 is provided to enclose each upper chamber 14. The lock core 2 includes a number of lower chambers 22 therein. Each lower chamber 22 receives a lower pin tumbler 23 therein. The lock core 2 further includes a keyway 24 for operation. A slot 12 is defined in a periphery of the main body 1 through which a C-clip 13 is extended to engage with a groove 21 defined in an end of the lock core 2 to thereby rotationally hold the lock core 2.

The present invention is characterized in that: a number of longitudinally spaced holes 18 are defined in the periphery of the main body 1, wherein each hole 18 is communicated with a lower end of an associated upper chamber 14. A number of branches 31 of a member 3 may be extended through the holes 18 to support the upper pin tumblers 15 and the springs 16 during change of the lock core 2.

Figure 2:
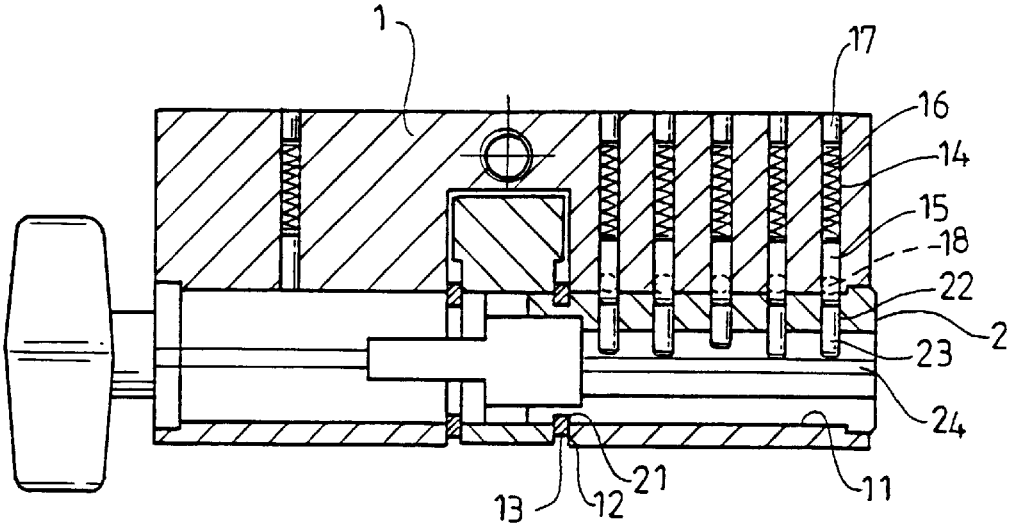
FIG. 2 is a longitudinal sectional view of the lock assembly.

In use, referring to FIG. 2, the key 4 (see FIG. 3) has not yet been inserted into the keyway 24 of the lock core 2, i.e., a split line (not shown) between the upper pin tumblers 15 and the lower pin tumblers 23 does not coincide with a split line (not shown) between the lock core 2 and the main body 1. At this moment, the lock core 2 is not removable.

Figure 3:
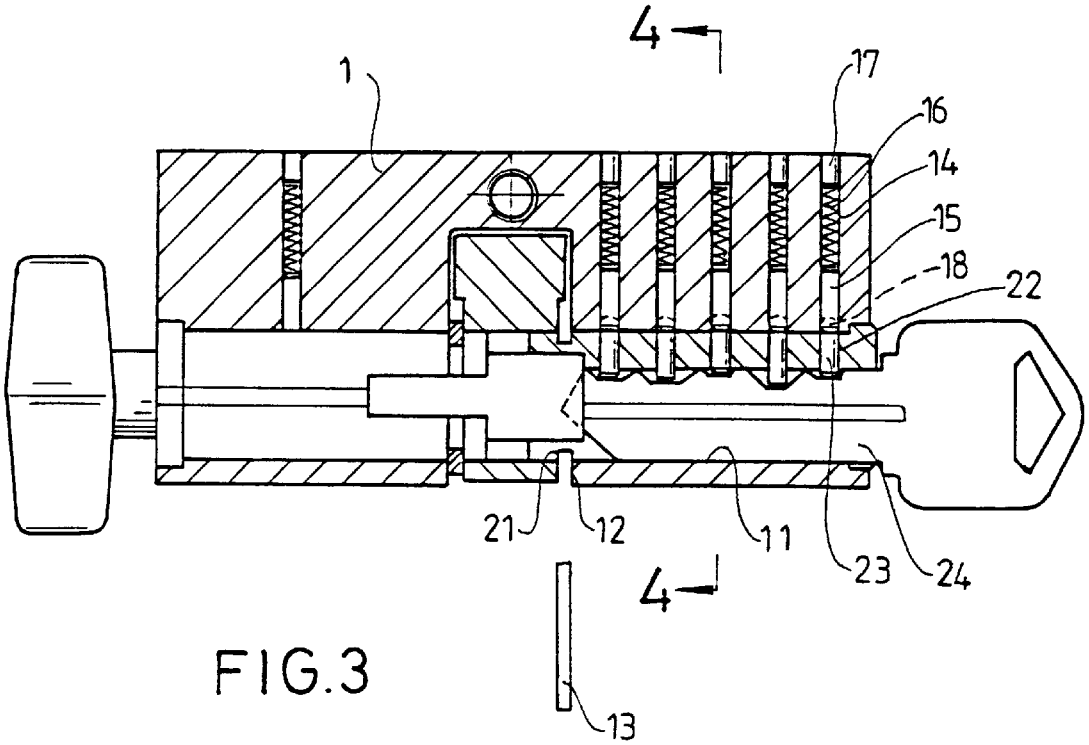
FIGS. 3–5 are sectional views illustrating change of the lock core of the lock assembly.
Figure 4:
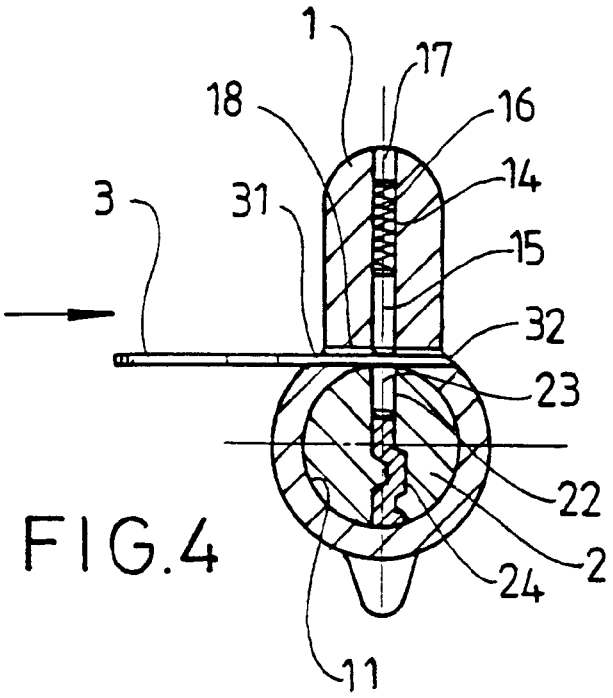
Figure 5:
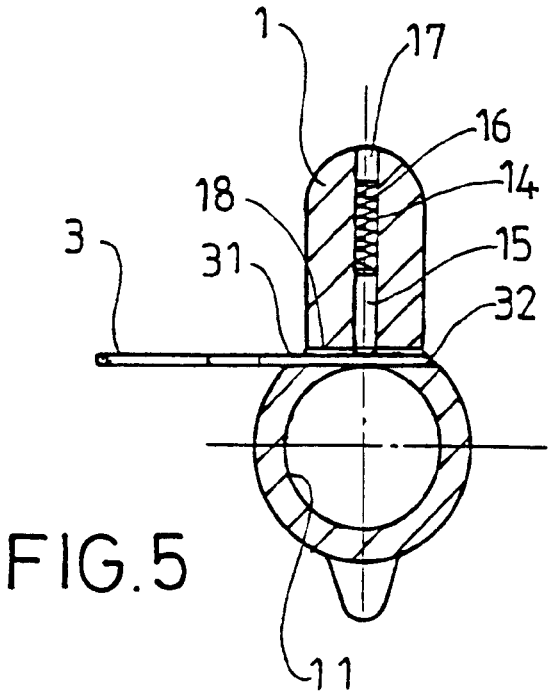

Referring to FIG. 3, when change of the lock core 2 is required, the key 4 for changing lock core 2 is inserted into the keyway 24 and rotated through an angle such that the split line between the upper pin tumblers 15 and the lower pin tumblers 23 coincides with the split line between the lock core 2 and the main body 1, as shown in FIG. 3. The branches 31 of the member 3 are inserted through the holes 18 to separate the upper pin tumblers 15 from the lower pin tumblers 23, best shown in FIG. 4. Accordingly, the lock core 2 can be removed, yet the upper pin tumblers 15 are retained in position (FIG. 5) until a new lock core is inserted into the compartment 11. Each branch 31 may have a beveled end 32 (FIG. 1) to assist in insertion thereof.

According to the above description, it is appreciated that the lock core 2 can be changed without resulting in falling of the upper pin tumblers 15.

Although the invention has been explained in relation to its preferred embodiment, it is to be understood that many other possible modifications and variations can be made without departing from the spirit and scope of the invention as hereinafter claimed.

What is claimed is:

1. A lock assembly, comprising: a main body including a compartment defined in a lower part thereof for removably receiving a lock core therein, the main body further including a plurality of upper chambers defined in an upper part thereof, said upper chambers respectively including upper pin tumblers received therein, said upper chambers further respectively including lower ends, the lock core including a plurality of lower chambers defined therein, said lower chambers respectively including lower pin tumblers received therein, the main body further including a plurality of holes defined in a periphery thereof each longitudinally spaced apart a predetermined distance, said holes respectively being in communication with the lower ends of said upper chambers, and further including a member having a plurality of branches each spaced apart said predetermined distance, said branches being removably inserted into said holes to support said upper pin tumblers to facilitate removal of the lock core.

2. The lock assembly according to claim 1, wherein said branches each have a beveled end to assist in the insertion thereof.

* * * * *